US008574665B2

(12) United States Patent
Wu et al.

(10) Patent No.: US 8,574,665 B2
(45) **Date of Patent: *Nov. 5, 2013**

(54) PALLADIUM PRECURSOR COMPOSITION

(75) Inventors: Yiliang Wu, Oakville (CA); Ping Liu, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/153,856

(22) Filed: Jun. 6, 2011

(65) Prior Publication Data

US 2012/0308719 A1 Dec. 6, 2012

(51) Int. Cl.

| | |
|---|---|
| ***B05D 5/12*** | (2006.01) |
| ***B05D 5/00*** | (2006.01) |
| ***C23C 18/00*** | (2006.01) |
| ***C23C 18/02*** | (2006.01) |

(52) U.S. Cl.

USPC ..... 427/125; 427/58; 427/123; 427/96.1; 106/1.05; 106/1.15; 106/286.1; 106/286.7; 252/518.1; 252/519.2; 252/519.21; 252/520.3

(58) Field of Classification Search

None

See application file for complete search history.

(56) References Cited

U.S. PATENT DOCUMENTS

| | | | | |
|---|---|---|---|---|
| 5,894,038 | A | 4/1999 | Sharma et al. | |
| 2003/0148024 | A1 * | 8/2003 | Kodas et al. | 427/125 |
| 2005/0005820 | A1 * | 1/2005 | Etheridge | 106/287.3 |
| 2008/0083299 | A1 * | 4/2008 | Simone et al. | 75/345 |
| 2009/0297802 | A1 * | 12/2009 | Sastry et al. | 428/209 |
| 2010/0233361 | A1 | 9/2010 | Hu et al. | |
| 2011/0174524 | A1 * | 7/2011 | Sharma et al. | 174/254 |

FOREIGN PATENT DOCUMENTS

| | | | |
|---|---|---|---|
| EP | 0989205 | A1 | 3/2000 |
| JP | 10072673 | A | 3/1998 |

OTHER PUBLICATIONS

Claim set for U.S. Appl. No. 13/290,825, filed Nov. 7, 2011 (no pub date avail).*

European Search Report mailed Oct. 22, 2012 for European Application No. 12170434.0.

* cited by examiner

*Primary Examiner* — Nathan Empie
*Assistant Examiner* — Lisha Jiang
(74) *Attorney, Agent, or Firm* — Fay Sharpe LLP

(57) ABSTRACT

A palladium precursor composition contains a palladium salt and an organoamine. The composition permits the use of solution processing methods to form palladium layers.

17 Claims, 2 Drawing Sheets

PALLADIUM PRECURSOR COMPOSITION

BACKGROUND

The present disclosure relates to compositions and processes for forming palladium layers on various objects. The compositions may be solutions, for example, and used to coat objects such as electronic devices or components of electronic devices.

Palladium (Pd) is a rare metal with many unique properties, resulting in its widespread use. For example, palladium is used in catalytic converters of automobiles to convert combustion byproducts into less harmful substances. Palladium is also used in many electronics devices, ceramic capacitors, fuel cells, and so on. Palladium structures are conventionally formed in such devices by electroplating, sputtering, or chemical vapor deposition (CVD). It would be desirable to use lower-cost approaches to form these palladium structures. There is a need for solution-processable compositions that can be used for palladium deposition.

BRIEF DESCRIPTION

Disclosed in various embodiments are palladium precursor compositions that can be used to form palladium layers and/or structures.

Disclosed in some embodiments is a palladium precursor composition that comprises a palladium salt, an organoamine, and a water immiscible organic solvent.

The palladium salt may be selected from the group consisting of palladium carboxylate, palladium chloride, palladium nitrate, palladium sulfate, palladium iodide, palladium cyanide, ethylenediamine palladium chloride, tetraaminepalladium bromide, bis(acetylacetonato) palladium, diamine dinitro palladium, and mixtures thereof.

In some embodiments, the organoamine may have a melting point below 50° C.

In specific embodiments, the organoamine is ethylamine, propylamine, butylamine, pentylamine, hexylamine, heptylamine, octylamine, nonylamine, decylamine, undecylamine, dodecylamine, tridecylamine, tetradecylamine, hexadecylamine, diaminobutane, diaminopentane, diaminohexane, diaminoheptane, diaminooctane, diaminononane, diaminodecane, dipropylamine, dibutylamine, dipentylamine, dihexylamine, diheptylamine, dioctylamine, dinonylamine, didecylamine, methylpropylamine, ethylpropylamine, propylbutylamine, ethylbutylamine, ethylpentylamine, propylpentylamine, butylpentylamine, triethylamine, tributylamine, or trihexylamine.

The palladium salt may be from about 1 to about 50 weight percent of the precursor composition. The molar ratio of the organoamine to the palladium salt may be from about 1:1 to about 5:1.

The palladium precursor composition has a surface tension less than 33 mN/m at 25° C.

The water immiscible organic solvent may be toluene, xylene, mesitylene, ethylbenzene, diethylbenzene, trimethyl benzene, methyl ethylbenzene, tetrahydronaphthalene, methy isobutyl ketone, methyl benzoate, benzyl benzoate, anisole, cyclohexanone, or acetophenone, or mixtures thereof.

The palladium salt and the organoamine may form a complex in the organic solvent, with the composition further comprising non-complexed organoamine.

In embodiments, the palladium precursor composition does not contain a reducing agent.

Also disclosed in embodiments is a process for forming a palladium layer on a substrate. A palladium precursor composition that comprises a palladium salt, an organoamine, and a water immiscible organic solvent is received. The substrate is solution coated with the palladium precursor composition. The palladium precursor composition is then heated to form the palladium layer.

The solution coating can be performed by spin coating, dip coating, spray coating, flexographic printing, offset printing, or inkjet printing the palladium precursor composition onto the substrate.

The heating may be performed at a temperature of from about 80° C. to about 350° C. for a period of from about 0.1 second to about 30 minutes.

Also disclosed in embodiments is a process for forming an electrically conductive palladium layer on an object. A palladium precursor solution that consists essentially of at least one palladium salt, at least one organoamine, and a water immiscible organic solvent is received. The palladium salt and the organoamine may form a complex dissolved in the organic solvent. The substrate is solution coated with the palladium precursor composition to form an amorphous coating on the object. The amorphous coating is then heated to form the palladium layer.

These and other non-limiting characteristics of the disclosure are more particularly disclosed below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following is a brief description of the drawings, which are presented for the purposes of illustrating the exemplary embodiments disclosed herein and not for the purposes of limiting the same.

DETAILED DESCRIPTION

Figure 1:
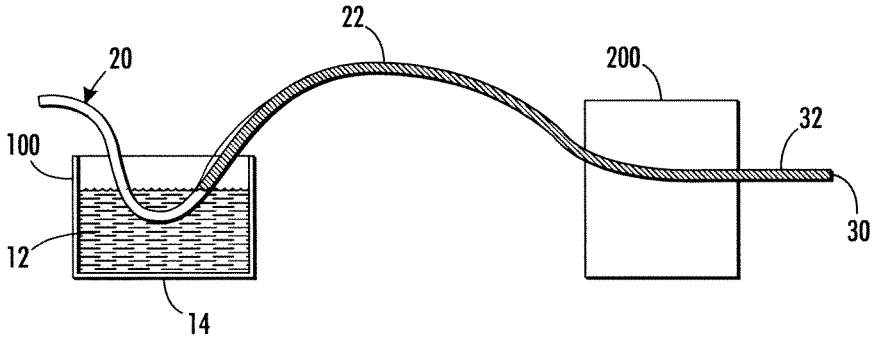
FIG. 1 is a schematic diagram showing the process of coating a substrate (e.g. a wire) of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The term "room temperature" refers to a temperature of about 23° C.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The present disclosure relates to palladium precursor compositions which can be used with liquid-based deposition processes to make a palladium layer on an object or a substrate. The palladium precursor compositions of the present disclosure comprise a palladium salt, an organoamine, and an organic solvent which is immiscible with water. They can be processed into palladium layers with high conductivity and good adhesion at low temperatures.

The palladium salt may be selected from the group consisting of palladium carboxylate, palladium chloride, palladium nitrate, palladium sulfate, palladium iodide, palladium cyanide, ethylenediamine palladium chloride, tetraaminepalladium bromide, bis(acetylacetonato) palladium, diamine dinitro palladium, or mixtures thereof.

In some embodiments, the palladium salt is a palladium carboxylate having a general structure of $Pd(OOCR^1)_x(OOCR^2)_{2-x}$, wherein $R^1$ and $R^2$ are independently selected from hydrogen, alkyl having 1 to 11 carbon atoms, alkenyl having 2 to about 13 carbon atoms, and alkynyl having 2 to about 13 carbon atoms. Hydrogen atoms on $R^1$ or $R^2$ may be substituted with another functional group such as CHO, OH, halogen, and the like. In specific embodiments, the palladium carboxylate is palladium acetate. The number x can be any number from 0 to 2, for example, 0, 0.01, 0.1, 1, 1.5, 1.57, 2.0, and the like.

The term "alkyl" refers to a radical composed entirely of carbon atoms and hydrogen atoms which is fully saturated and of the formula $—C_nH_{2n+1}$. The alkyl radical may be linear, branched, or cyclic.

The term "alkenyl" refers to a radical composed entirely of carbon atoms and hydrogen atoms which contains at least one carbon-carbon double bond. An alkenyl radical may be linear or branched. Aromatic rings are not considered to be alkenyl.

The term "alkynyl" refers to a radical composed entirely of carbon atoms and hydrogen atoms which contains at least one carbon-carbon triple bond.

It should be noted that the palladium salt is a molecular compound. Pd—Pd bonds may be present in the molecular compound. However, the palladium salt should not be considered to be a nanoparticle or similar material. The palladium atom in the salt is not zero valent, while palladium atoms are zero valent in the nanoparticle form.

The organoamine may function as a complexing agent. The organoamine may be any primary, secondary, or tertiary amine. The organoamine can also be a monoamine, diamine, or polyamine. More specifically, the organoamine may contain one, two, or more amine groups of Formula (I):

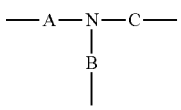

Formula (I)

wherein A, B, and C are independently selected from hydrogen and an organic group, and at least one is an organic group. When the tertiary amine contains more than one such amine group, the nitrogen atoms are not directly bonded to each other. An organic group contains at least one carbon atom. Exemplary organic groups include alkyl, aryl, substituted alkyl, and substituted aryl.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms).

The term "substituted" refers to at least one hydrogen atom on the named radical being substituted with another functional group, such as halogen, hydroxyl, mercapto (—SH), —CN, $—NO_2$, —COOH, and $—SO_3H$. An exemplary substituted alkyl group is a perhaloalkyl group, wherein one or more hydrogen atoms in an alkyl group are replaced with halogen atoms, such as fluorine, chlorine, iodine, and bromine. Besides the aforementioned functional groups, an aryl or heteroaryl group may also be substituted with alkyl or alkoxy. Exemplary substituted aryl groups include methylphenyl and methoxyphenyl.

Some specific examples of organoamines include ethylamine, propylamine, butylamine, pentylamine, hexylamine, heptylamine, octylamine, nonylamine, decylamine, undecylamine, dodecylamine, tridecylamine, tetradecylamine, hexadecylamine, diaminobutane, diaminopentane, diaminohexane, diaminoheptane, diaminooctane, diaminononane, diaminodecane, dipropylamine, dibutylamine, dipentylamine, dihexylamine, diheptylamine, dioctylamine, dinonylamine, didecylamine, methylpropylamine, ethylpropylamine, propylbutylamine, ethylbutylamine, ethylpentylamine, propylpentylamine, butylpentylamine, triethylamine, tributylamine, and trihexylamine.

In some embodiments, the organoamine has a melting point less than 50 degree C., including a melting point less than room temperature. In other words, the organoamine is a liquid at room temperature. The liquid form/low melting point is important to achieve a uniform palladium coating. After liquid depositing the precursor composition, an amorphous coating layer will be formed if an organoamine with a low melting point is used. On the other hand, an organoamine with a high melting point will crystallize out after deposition of the precursor composition, which may cause high surface roughness and holes in the final palladium coating.

In some embodiments, the organoamine is not an amino acid compound. In other words, with reference to Formula (I), none of A, B, or C are substituted with a —COOH group. In some other embodiments, the organoamine is an amino acid compound (i.e. at least one of A, B, and C is substituted with —COOH).

In more specific embodiments, the organoamine is a primary monoamine, i.e. a compound of the formula $NH_2—R^3$, where $R^3$ is alkyl having from about 2 to about 18 carbon atoms, including from about 5 to about 14 carbon atoms, or from about 7 to about 18 carbon atoms.

Without being limited by theory, it is believed that the palladium salt and the organoamine form a palladium amine complex. This is usually evidenced by a color change. For example, palladium acetate is a reddish solution in toluene, but when an organoamine such as octylamine is added, the solution changes into a light yellow color. The palladium amine complex helps to dissolve the palladium salt in the organic solvent to permit high loading of the salt, and as a result, a high palladium content in the precursor composition. In embodiments, the palladium amine complex is dissolved in the solvent, and the resulting precursor composition is a clear solution. It should be noted that the composition may also comprise non-complexed palladium salt molecules. In specific embodiments, the composition comprises the palladium amine complex and an excess amount of the organoamine in non-complexed form.

In embodiments, the molar ratio of the organoamine to the palladium salt is from about 1:1 to about 5:1. In more specific embodiments, the molar ratio of organoamine to palladium salt is from about 2:1 to about 5:1, or from about 2:1 to about 3:1. In some embodiments, the molar ratio of the organoamine to the palladium salt is at least 2:1 to ensure good dissolution of the palladium salt in the solvent.

In embodiments, an organic solvent which is immiscible with water is used. When a given organic solvent is mixed with water at about equal amounts by volume, if a phase separation is detected (either visually or by instruments such as light scattering or refractive index) after settling, the solvent is considered to be water immiscible. The palladium salt, the organoamine, and the resulting palladium amine complex should be soluble in the selected solvent. For example, at least 0.5 wt % of the amount of the given component added to the solvent should dissolve, including at least 1 wt %, or at least 10 wt % of the amount added. The non-soluble portion can be removed from the organic solvent by, for example, filtration.

Any suitable water immiscible organic solvent can be used. In some embodiments, the organic solvent may be a hydrocarbon solvent, for example a substituted hydrocarbon or an aromatic hydrocarbon solvent. Specifically, the hydrocarbon solvent has at least 6 carbon atoms, from 6 to about 25 carbon atoms. Exemplary solvents include toluene, xylene, mesitylene, ethylbenzene, diethylbenzene, trimethyl benzene, methyl ethylbenzene, tetrahydronaphthalene, chlorobenzene, dichlorobenzene, trichlorobenzene, chlorotoluene, and the like, or mixtures thereof. In other embodiments, the organic solvent is a ketone, ester, ether, and the like. Exemplary solvents include methy isobutyl ketone, methyl benzoate, benzyl benzoate, anisole, cyclohexanone, acetophenone, and the like. In some embodiments, the organic solvent has a boiling point at least 80° C., including at least 100° C. In some specific embodiments, the solvent has a high boiling point at least 150° C.

The palladium salt typically makes up from about 1 to about 50 weight percent (wt %) of the precursor composition. In more specific embodiments, the palladium salt makes up from about 5 wt % to about 30 wt % of the precursor composition.

The precursor composition can further include another metal salt, such as silver (Ag), gold (Au), copper (Cu), nickel (Ni), rhodium (Rh), cobalt (Co), zinc (Zn), platinum (Pt), palladium (Pd), and the like. For example, silver acetate can be used to in combination with palladium acetate to form a Ag—Pd alloy. The additional metal salt in the composition can be present in an amount of, for example, from about 0.1 wt % to about 40 wt %, including from about 1 wt % to about 20 wt % of the precursor composition.

The palladium precursor composition has a surface tension of less than 33 mN/m, including less than 30 mN/m, or less than 28 mN/m, or for example from about 23 mN/m to about 30 mN/m. This low surface tension enables a uniform coating of palladium to be formed on the substrate. The selection of a suitable water-immiscible organic solvent provides the desired surface tension. The palladium precursor composition has a viscosity from about 0.8 to about 50 cps, including from about 2 to about 30 cps.

In embodiments, the palladium precursor composition does not contain a reducing agent. Some examples of reducing agents include formic acid and formic acid salts or esters, hydrazine, ammonium compounds, amine borane compounds, alkali metal borohydrides, oxalic acid, alkali or alkaline earth sulfites, and the like.

The palladium precursor composition can be used as a coating solution to apply a palladium coating or layer onto any substrate or object. The palladium precursor composition can be used to solution coat the substrate. "Solution coating" and "solution processing" refer to a process where a liquid is applied to the substrate to form a coating. This is in contrast to, for example, electroplating, which requires a plate to remain immersed in a solution and then exposed to an electric current to form a metal coating on the plate.

Exemplary solution coating processes include dip coating, spin coating, spray coating, flexographic printing, offset printing, or inkjet printing (where the palladium precursor composition is ejected onto the substrate by an inkjet printhead). Certain processes involve solution coating the substrate with the palladium precursor composition to form a coating on the substrate. In embodiments, the coating has a thickness of from about 10 nanometers to about 50 micrometers, including from about 10 nm to about 30 micrometers, or from about 50 nm to about 5 micrometers, or from about 80 nm to about 1 micrometer.

The palladium precursor composition is then heated to form the palladium layer on the substrate. The heating causes the palladium amine complex or palladium salt to thermally decompose to form a solid palladium layer. In contrast, in electroless plating, the palladium salt or complex is chemically reduced to palladium. The heating may be performed at a temperature of from about 80° C. to about 350° C. In other embodiments, the heating is performed at a temperature of from about 120° C. to about 300° C., or from about 150° C. to about 250° C. Regardless of the substrate used, the heating temperature is desirably one that does not cause adverse changes in the properties of any previously deposited layer(s) or the substrate (whether a single layer substrate or multilayer substrate). The heating may be performed for a period of up to 30 minutes, and could be for a period as short as 0.1 seconds depending on the size of the palladium layer and the heating method. The heating can be performed in air, in an inert atmosphere (for example, under nitrogen or argon), or in a reducing atmosphere (for example, under nitrogen containing from 1 to about 20 percent by volume hydrogen). The heating can also be performed under normal atmospheric pressure or at a reduced pressure of, for example, from about 1000 millibars to about 0.01 millibars. Examples of heating techniques may include thermal heating (for example, a hot plate, an oven, and a burner), infra-red ("IR") radiation, a laser beam, flash light, microwave radiation, or UV radiation, or a combination thereof.

The coating method described herein can also be repeated to build up a thicker palladium layer on the object. For example, in embodiments, the thickness of the final layer may also be from about 10 nanometers to about 50 micrometers, or from about 50 nanometers to about 30 micrometers, or from about 50 nm to about 5 micrometers, or from about 80 nm to about 1 micrometer.

Prior to heating, the coating containing the palladium salt or palladium amine complex may be electrically insulating or have very low electrical conductivity. Heating results in an electrically conductive layer of palladium. The conductivity of the palladium layer produced by heating is, for example, more than about 100 Siemens/centimeter ("S/cm"), more than about 1000 S/cm, more than about 2,000 S/cm, more than about 5,000 S/cm, or more than about 10,000 S/cm or more than 50,000 S/cm.

In some embodiments, prior to heating, the coating containing the palladium salt or palladium amine complex is an amorphous layer.

In other embodiments, the palladium layer is not conductive. Although heating causes the decomposition of the palladium complex into palladium, due to the presence of other ions (from the salt) or a residual amount of the organoamine and its decomposed form, or due to the presence of insulative additives in the precursor composition such as polymers, the palladium layer may not necessarily be conductive. However, the palladium layer does have a shiny metallic white color.

In some embodiments, reducing agents may not be needed to prepare and obtain the palladium layer on the object or substrate. Thus, such reducing agents are not present in the palladium precursor composition and are not separately added as an additional processing step.

In particular embodiments, the palladium precursor composition consists essentially of one or more palladium salts, one or more organoamines, and one or more solvents. The precursor composition has the basic characteristic of being solution-processable. The precursor composition does not contain a reducing agent. In specific embodiments, the organoamine is a primary monoamine.

It is specifically contemplated that the processes used herein can be used for coating a wire. It should be noted that any wire can be coated with the palladium precursor composition, regardless of the diameter, shape, or length of the wire. Both organic materials (e.g. plastic) and inorganic materials (e.g. copper) can be used as the substrate for the wire. The wire may be bare (i.e. uncovered with other layers) or may be insulated by the addition of other layers around a core. The wire may be single-stranded (i.e. solid), multiple stranded, and/or twisted. Exemplary inorganic materials include metals such as copper, aluminum, tungsten, zinc oxide, silicon, and the like. Exemplary plastic wires include wires made from polyimide, polyester, polyamide (Nylor), polycarbonate, polyethylene, polyacrylate, and the like.

Optionally, a receiving layer can be applied prior to drawing the object (i.e. wire) through the palladium precursor composition. The receiving layer may enhance the adhesion of the precursor composition on the object. Any suitable receiving layer can be used. Exemplary receiving layers can be formed from, for example, a silane, especially a silane comprising an amino group.

If desired, additional layers can be applied on top of the palladium layer (the additional layers may be referred to as overcoat layers). Any layer known in the art may be applied, particularly materials with good scratch resistance. In embodiments, materials that can be used to form an overcoat layer include an epoxy resin, a polyurethane, a phenol resin, a melamine resin, a polysiloxane, a poly(silsesquioxane), and the like. Polysiloxane and poly(silsesquioxane) precursors (for example sol-gel approach) can be used to from a highly crosslinked polysiloxane or poly(silsesquioxane) overcoat layer. In some specific embodiments, the overcoat layer is a crosslinked polysiloxane, a crosslinked poly(silsesquioxane), or a crosslinked layer comprising poly(vinylphenol) and a melamine-formaldehyde resin. The thickness of the overcoat layer may be for example from about 10 nm to about 10 micrometers, including from about 10 nm to about 5 micrometers, or from about 50 nm to about 1 micrometer. In embodiments, the overcoat layer is transparent to visible light. In other words, the overcoat layer is colorless. This will ensure the visibility of the palladium layer.

FIG. 1 is a schematic diagram illustrating the processes described herein. In step 100, a palladium precursor coating solution 12 is presented in a vessel 14. A wire 20 is drawn through the coating solution to form a coating 22 on the wire. Note that this allows for continuous production of the wire. Next in step 200, the coating 22 is annealed by exposure to heat. The result is a wire 30 having a palladium layer 32. The original wire 20 serves as a substrate upon which the palladium layer is located.

Figure 2:
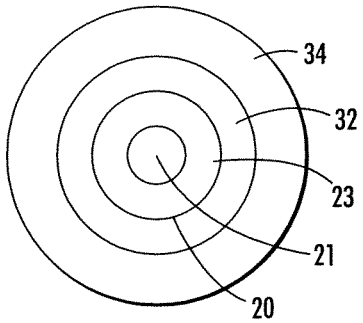
FIG. 2 is a cross-sectional view of a wire having a palladium layer and an overcoat layer atop the palladium layer.

FIG. 2 is a cross-sectional view of the final wire 30. At the center is the original wire 20. As noted above, this original wire 20 may comprise a core 21 and other layers prior to receiving the palladium layer. For example, the original wire may include a receiving layer 23. The palladium layer 32 covers the wire 20. An overcoat layer 34 may surround the palladium layer 32.

It may be desirable to clean the wire prior to drawing the wire through the palladium precursor composition. This can be done by, for example, wiping the wire with isopropanol or using a plasma treatment on the surface of the wire. This will aid in maintaining a uniform coating.

The following examples are for purposes of further illustrating the present disclosure. The examples are merely illustrative and are not intended to limit devices made in accordance with the disclosure to the materials, conditions, or process parameters set forth therein.

EXAMPLES

Comparative Example

Palladium acetate (trimer) was purchased from Alfa Aesar. 0.1 grams of palladium acetate was added into 0.7 grams toluene. The salt was partially soluble and displayed an orange-brown color.

Example 1

Palladium acetate (trimer) was purchased from Alfa Aesar. 0.1 grams of palladium acetate was added into 0.7 grams toluene. 0.22 grams of octylamine was then added into the mixture, and the mixture was then shaken. The insoluble part of the palladium salt was dissolved to form a very stable light yellow solution.

Test

The solutions of the Comparative Example and Example 1 were each spin-coated onto a glass slide to form a film. The solution of Example 1 formed a uniform film without crystallization or precipitation. In contrast, the solution of the Comparative Example formed a non-uniform film with precipitates of the salt after spin coating.

After being heated at 200-250° C. for a few minutes, the film of Example 1 changed into first a black color, then a shiny metallic color. The palladium thin film was measured to be very conductive by two probe measurement having a conductivity estimated to be around $1.0\times10^4$S/cm.

Example 2

Figure 3:
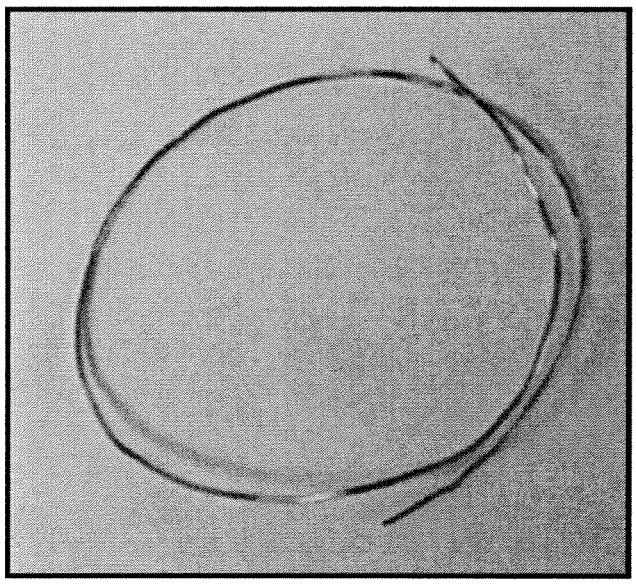
FIG. 3 is a picture of a copper wire with a palladium coating.

A copper wire was dipped into the solution of Example 1 to coat the surface of the wire with the palladium precursor composition. After being slowly pulled out of the solution, the wire was heated at 200° C. in an oven for 5 minutes under reducing gas (4.5% hydrogen in nitrogen). A shiny metallic white wire was obtained, and is seen in FIG. 3. The palladium coating was very robust when washed with solvents such as isopropyl alcohol (IPA) and toluene, i.e. the coating did not dissolve or flake. The palladium coating also resisted damage under mechanical rubbing.

Example 3

Palladium acetate (trimer) was purchased from Alfa Aesar. 0.1 grams of palladium acetate was added into 0.7 grams benzyl benzoate. 0.22 grams of octylamine was then added into the mixture, and the mixture was then shaken. The insoluble part of the palladium salt was dissolved to form a very stable light yellow solution.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A palladium precursor composition, comprising a palladium salt, an organoamine, and a water immiscible organic solvent;

wherein the palladium salt is a palladium carboxylate;

wherein the organoamine is octylamine, nonylamine, or decylamine;

wherein the palladium salt is from about 5 wt % to about 30 wt % of the precursor composition; and wherein at least a portion of the palladium salt and the organoamine form an amorphous palladium organoamine complex.

2. The precursor composition of claim 1, wherein the palladium salt is palladium acetate.

3. The precursor composition of claim 1, wherein the organoamine has a melting point below 50° C.

4. The precursor composition of claim 1, wherein the molar ratio of the organoamine to the palladium salt is from about 1:1 to about 5:1.

5. The precursor composition of claim 1, wherein the palladium precursor composition has a surface tension less than 33 mN/m at 25° C.

6. The precursor composition of claim 1, wherein the solvent is selected from the group consisting of toluene, xylene, mesitylene, ethylbenzene, diethylbenzene, trimethyl benzene, methyl ethylbenzene, tetrahydronaphthalene, methy isobutyl ketone, methyl benzoate, benzyl benzoate, anisole, cyclohexanone, acetophenone, and mixtures thereof.

7. The precursor composition of claim 1, wherein the composition further comprises non-complexed organoamine.

8. A process for forming a palladium layer on a substrate, comprising:

receiving a palladium precursor composition that comprises a palladium salt, an organoamine, and a water immiscible organic solvent;

solution coating the substrate with the palladium precursor composition; and heating the palladium precursor composition to form the palladium layer;

wherein the palladium salt is a palladium carboxylate; and wherein the organoamine is octylamine, nonylamine, or decylamine, and wherein the palladium salt is from about 5 wt % to about 30 wt % of the precursor composition; and wherein at least a portion of the palladium salt and the organoamine form an amorphous palladium organoamine complex.

9. The process of claim 8, wherein the solution coating is performed by spin coating, dip coating, spray coating, flexographic printing, offset printing, or inkjet printing the palladium precursor composition onto the substrate.

10. The process of claim 8, wherein the heating is performed at a temperature of from about 80° C. to about 350° C. for a period of from about 0.1 second to about 30 minutes.

11. The process of claim 8, wherein the palladium precursor composition contains palladium organoamine complex and non-complexed organoamine.

12. The process of claim 8, wherein the palladium salt is palladium acetate.

13. The process of claim 8, wherein the organoamine is a liquid at room temperature.

14. The process of claim 8, wherein the molar ratio of the organoamine to the palladium salt is from about 1:1 to about 5:1.

15. The process of claim 8, wherein the palladium precursor composition does not contain a reducing agent, and wherein no reducing agent is added.

16. The process of claim 8, wherein the organic solvent is toluene or trimethyl benzene, or mixtures thereof.

17. A process for forming an electrically conductive palladium layer on an object, comprising:

receiving a palladium precursor solution that comprises at least one palladium salt, at least one organoamine, and at least one water immiscible organic solvent, wherein at least a portion of the palladium salt and the organoamine form an amorphous palladium organoamine complex;

solution coating the object with the palladium precursor solution to form an amorphous coating on the object; and heating the amorphous coating to form the electrically conductive palladium layer;

wherein the palladium salt is palladium acetate;

wherein the organoamine is octylamine or decylamine;

and wherein the palladium salt is from about 5 wt % to about 30 wt % of the precursor composition.

* * * * *